US005435165A

United States Patent [19]

Morel et al.

[11] Patent Number: 5,435,165

[45] Date of Patent: Jul. 25, 1995

[54] ROLLING METHOD FOR METAL SLAB

[75] Inventors: Michel Morel, Chelles; Lucien Burnouf, Arnouville-les-Gonesse; André Ravenet, Les Mureaux, all of France

[73] Assignee: Clecim, Cergy Pontoise, France

[21] Appl. No.: 29,243

[22] Filed: Mar. 10, 1993

[30] Foreign Application Priority Data

Mar. 10, 1992 [FR] France ..... 92 02860

[51] Int. Cl.[6] ..... B21B 39/16

[52] U.S. Cl. ..... 72/251; 72/365.2

[58] Field of Search ..... 72/227, 229, 251, 250, 72/365.2, 420

[56] References Cited

U.S. PATENT DOCUMENTS 1,498,134 6/1924 Sykes ..... 72/251
2,018,255 10/1935 Drexler ..... 72/251

FOREIGN PATENT DOCUMENTS 426530 3/1926 Austria .
658441 6/1929 France .
712672 10/1931 France .
1293450 4/1992 France .
0178114 10/1984 Japan ..... 72/251
0038715 2/1987 Japan ..... 72/251
3-35805 2/1991 Japan .

*Primary Examiner*—Lowell A. Larson
*Assistant Examiner*—Thomas C. Schoeffler
*Attorney, Agent, or Firm*—Pollock, Vande Sande & Priddy

[57] ABSTRACT

A method to enter a metal slab (2) into a roll stand (10) and a rolling unit to enhance the entry of the slab into the roll gap (13) between the working cylinders (1, 1') of the rolling mill. At least one of the last rollers (45) of the table (3), located immediately upstream of the roll stand (10) in the direction of entry, is mounted for vertical movement with respect to the table (3) and is subject to a lifting load at least equal to the weight of the nose (22) of the slab (2) in such a manner that, at the end of its forward motion towards the roll stand, the said nose (22) is supported by the movable roller (45), which thus is applied perfectly against the lower surface (20) of the slab and is rotary-driven in the direction of entry so as to exert on the slab (2) a thrust load, which is added to the load exerted at least by the first driven roller (32) of the table (3) to enhance the introduction of the slab (2) into the roll gap (13).

8 Claims, 3 Drawing Sheets

ROLLING METHOD FOR METAL SLAB

FIELD OF THE INVENTION

This invention relates to a method for improving the entry of a metal slab into a roll stand and also encompasses an improved metal slab roll unit designed to enhance such entry.

BACKGROUND OF THE INVENTION

More generally, a roll stand comprises a set of overlapping rollers within a rigid frame. For instance, in a "Quarto" assembly, the rolling mill comprises two working cylinders, which are associated, respectively, with two backing cylinders and whose opposite generatrices define a roll gap for the product to be rolled. Clamping means, supported by the rigid frame, determine crushing of the product whose thickness, at the rolling mill entrance, is greater than the roll gap.

The product to be rolled, whose shape is a bar or a plane slab, is conveyed normally to the stand, via a input roller table comprising several rollers with parallel axes which define a supporting plane of the slab, more or less at the level of the roll gap. At least a few of these rollers are rotary-driven in order to cause, by a friction effect, the forward motion of the slab towards the working cylinders. A second roller table, located at the exit side, receives the product after rolling.

In so-called "reversing" rolling mills, the roll stand is associated with two roller tables located on both sides and used alternately as infeed table and reception table, depending on the flow direction of the product.

Since the product is thicker before going through the mill, the supporting plane defined by the rollers of the table located upstream must normally be above the upper generatrix of the lower working cylinder and at a distance substantially equal to half the thickness reduction, in such a manner that the medial horizontal plane of the slab coincides substantially with the medial plane of the roll gap situated at equal distance from both cylinders.

Conversely, the supporting plane defined by the rollers of the exit table should, theoretically, be located at the level of the upper generatrix of the lower working cylinder, in order to accommodate the rolled product when it leaves the roll gap. To avoid any risk of jamming, the exit table is preferably slightly lowered with respect to the lower cylinder, but the consequence is that the nose of the rolled slab is liable to fall onto the exit rollers and may be damaged.

It has thus been suggested, in a particular embodiment described in JP-A-30.35805, to reinforce the nose of the plate slab by giving it an undulated shape. To this end, the last roller of the input table is raised above the normal level, using hydraulic jacks supported by two chocks supporting the rollers' extremities. In this way, when entering the slab into the roll gap, the nose can be bent upwards, then downwards once the slab has been entered properly. At this moment, the last roller is brought back to its normal level to complete the pass.

However, the consequence of this technique is that the movable roller as well as its chocks must support large loads in order to cause the two bends of the slab. Moreover, the nose of the slab must be bent again to pass into the roll gap, and this makes entry more difficult.

Still, more generally speaking, the entry of the slab into the roll gap may prove difficult, and this causes its thickness to be reduced to a lesser extent than would be allowed, theoretically, by the power of the rolling mill.

Indeed, when the product is already engaged between the working cylinders, the crushing action exerted by these cylinders generates frictions which are sufficient to move the product forward.

Conversely, during the entry phase into the roll stand, in order to reduce the thickness significantly, the frictions exerted by the cylinders on the edges of the slab may be insufficient to drive the product and it may be necessary to push it and help it to engage into the cylinders.

In order to enhance the entry of the slab, it can be given a certain velocity before contacting the cylinders, in order to benefit from an inertia effect, but such an effect remains limited. Quite frequently, the slab will not engage, and this may call for reducing its thickness to less than the desired value, allowed by the power of the rolling mill. The number of passes is thus increased.

To obviate this drawback, it is not sufficient to increase the torque applied to the driven rollers, since the thrust load exerted on the slab depends on the friction between the slab and the rollers.

In studying the conditions of passage of the slab through the roll gap, it has been noted that, after a few passes, the slab under rolling becomes slightly bent and, consequently rests, in practice, on the table only by its edge facing the roll stand, whereas the thrust action is often exerted by only one roller.

SUMMARY OF THE INVENTION

The purpose of the invention is to obviate this drawback while ensuring better application of the slab to be rolled on the table and, consequently, increasing the thrust load exerted on the slab by the rollers.

The invention thus relates to an improved method for entering a slab into a rolling mill which, for a given thickness reduction, decreases the risk to that the slab will fail to "bite" and hence increases the potential thickness reduction at every pass.

According to the invention, at least one of the last rollers of the table, located immediately before the roll stand, in the direction of entry, is mounted for vertical movement, with respect to the table, and undergoes a lifting stress at least equal to the weight of the nose of the slab, such that, on completion of the forward motion towards the roll stand, the nose is supported by the movable roller which is thus perfectly applied to the lower surface of the slab and is, moreover, rotary-driven into the direction of entry in order to exert on the slab a thrust load which is added to the load exerted at least by the first driven roller of the table to enhance the entry of the slab into the roll gap.

To increase the thrust load of the movable roller, it is advantageous to adjust its level in such a manner that, when it supports simply the weight of the nose of the slab, the slab is raised with respect to the medial plane of the roll gap and touches, first, the upper cylinder with its upper edge and, moving further, is lowered by the upper cylinder until it touches the lower cylinder while pushing away the movable roller which yields elastically and whose application load onto the lower surface of the slab is then increased.

The invention also relates to an improved unit for the implementation of the method and comprising a roll stand associated with at least one roller table at least a few of whose rollers are rotary-driven in the direction of motion of the slab towards the roll stand so as to push the slab towards the roll gap between the upper and lower working cylinders.

According to the invention, at least one of the last rollers of the table, located immediately before the roll stand, is rotary-driven into the direction of entry of the slab and is mounted for vertical movement on the table by bearing against the table via at least an elastic lifting and application means of the roller on the lower surface of the slab, whereas the elastic lifting means is set in order to compensate significantly for the weight of the nose of the slab, with the addition of the weight of at least the latter and to enable lowering the last roller by yielding elastically under an action directed downwards and exerted by the slab upon insertion into the roll gap.

Preferably, the last rollers of the supporting table which are closest to the roll stand are mounted on a chassis resting on elastic lifting means and constituting a movable table, at least a few such rollers being rotary-driven in the direction of entry.

Particularly advantageously, the driving rollers of the movable table and of the main table are synchronously driven by a common control means whose power is divided automatically between the rollers always in contact with the slab.

According to a first embodiment, the movable chassis rests entirely on elastic supporting means, in order to move vertically while adapting to the orientation of the portion of the slab resting on the chassis.

According to another embodiment, the movable chassis is articulated, on its side opposite the roll stand, around an axis parallel to the axes of the working cylinders and rests on an elastic lifting means by its side oriented to the roll stand.

BRIEF DESCRIPTION OF THE DRAWINGS

The invention will be better understood with the aid of the following description of an exemplary embodiment given for information purposes and shown in the appended drawings.

DESCRIPTION OF PREFERRED EMBODIMENT

Figure 1:
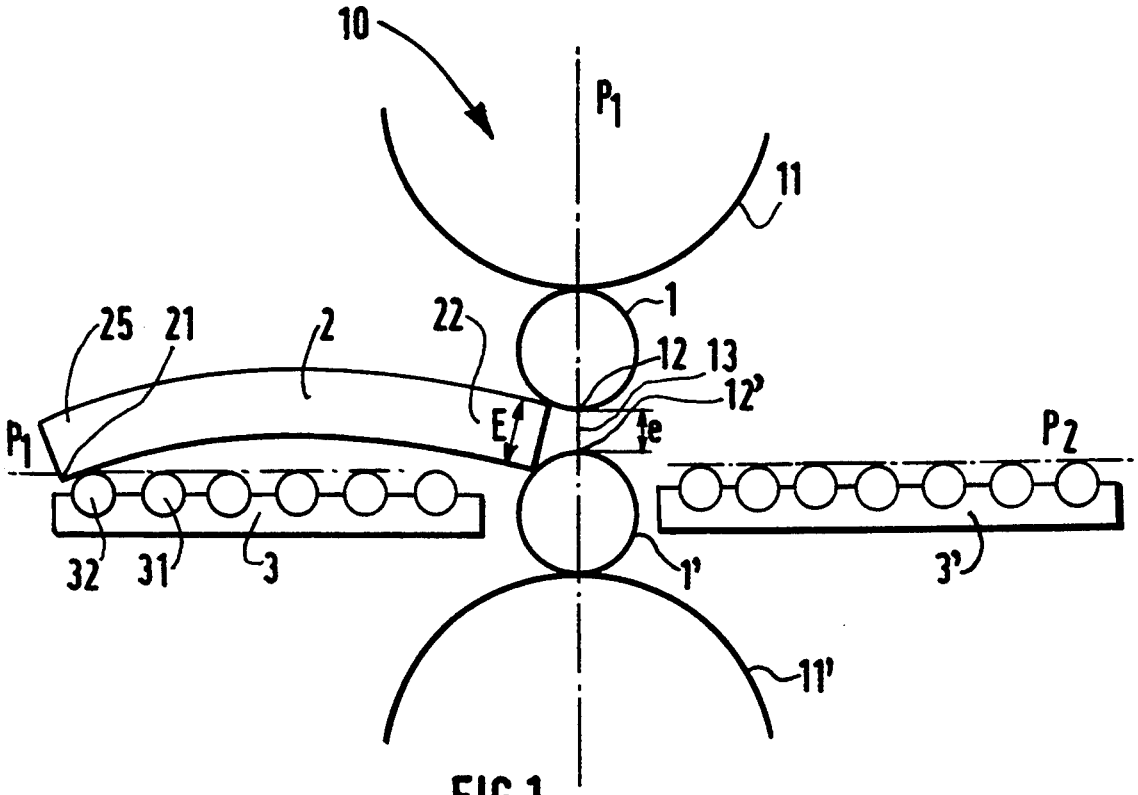
FIG.1 PRIOR ART
FIG. 1 shows schematically a conventional reversing roll stand, in a Quarto assembly.

FIG. 1 shows a classical roll stand comprising, in a Quarto assembly, two working cylinders 1, 1', resting, respectively, on two backing cylinders 11, 11', and associated with two roller tables 3, 3', arranged respectively on both sides of the generally vertical clamping plane S in which the axes of the cylinders are located.

The facing generatrixes 12, 12' of the two working cylinders 1, 1' are separated by a roll gap 13 for passage of the product to be rolled, which is shaped as a slab 2.

The relative positions of the cylinders can be adjusted using clamping devices (not shown) and, in practice, the width (e) of the roll gap 13 is less than the thickness (E) of the product 4 in order to determine, when the product passes, a thickness reduction $R=E-e$.

In order to determine the forward motion and the pass of the product 2, the roll stand is associated with an infeed table 3 consisting of a set of rollers 31 whose axes are parallel to those of the working cylinders 1, 1' and which are aligned so as to define a horizontal plane P1 tangent to the rollers 31.

A second roller table 3' is generally located at the exit end to receive the product after rolling. In reversing mills, both roller tables 3, 3' are used, alternately, for infeed and exit.

Normally, the supporting plane P1 of the infeed table 3 passes beneath the upper generatrix 12' of the lower working cylinder 1', at a distance substantially equal to half the thickness reduction R so that the medial plane Q, i.e. the plane situated at equal distance from both surfaces of the slab, coincides with the medial plane P of the roll gap.

The supporting plane P2 of the exit table 3' is situated substantially at the level of the upper generatrix 12' of the lower working cylinder 1' in order to receive the product after rolling, a small difference in level being simply accommodated to avoid risks of jamming.

As already noted, at least some of the rollers 31 of each roller table 3 (3') are rotary-driven in order to control the motion of the slab 2 towards the roll stand and its penetration between the cylinders 1, 1'.

As long as the slab 2 is perfectly plane, it rests more or less regularly on the rollers 31 and the thrust load can be distributed over several driving rollers.

However, it has been observed that, after several passes, the slab 2 may bend slightly upwards, taking generally an upward convex shape, as represented in FIG. 1 in exaggerated form.

As a result, when the slab 2 penetrates between the rollers 1 and 1', it rests solely by its edge 21 facing the roll stand 10 on the roller 32 farthest from the roll stand and this roller alone must exert the thrust load. Since this load is transmitted solely by friction, it is insufficient to cause the entry of the nose 22 of the slab 2 between the cylinders, thus preventing entry if the thickness reduction foreseen is too great.

Figure 2:
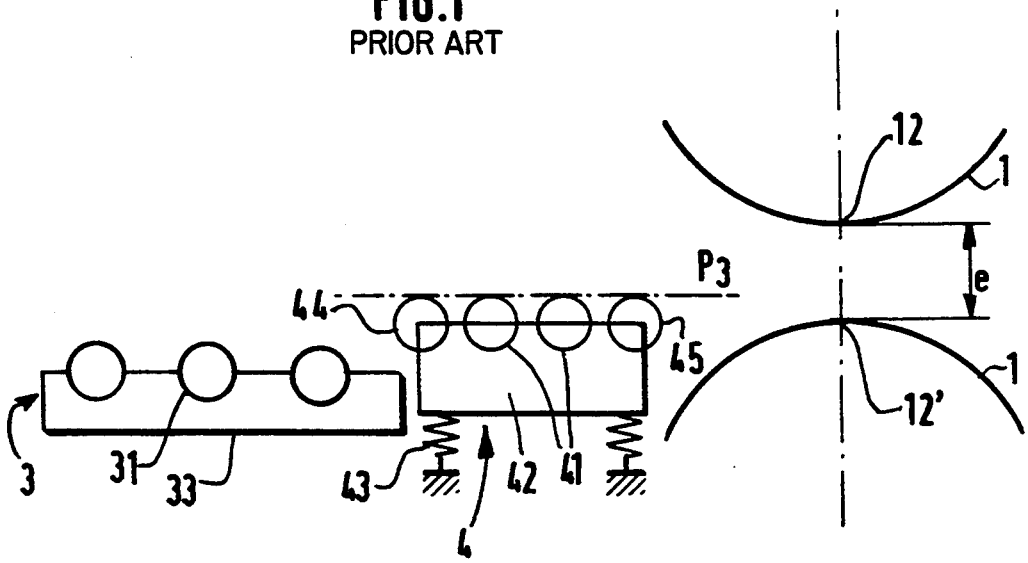
FIG. 2 represents schematically a roller table according to the invention.
Figure 3:
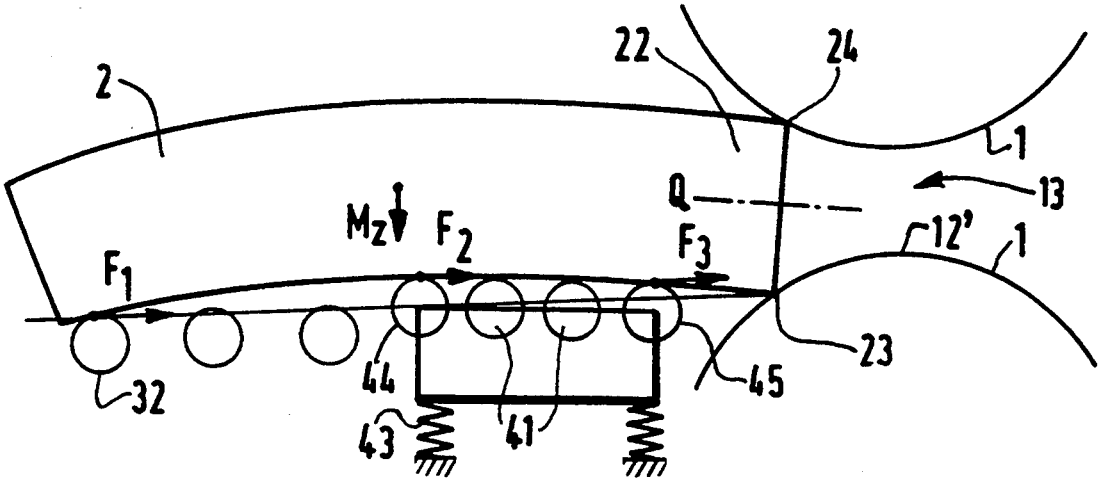
FIG. 3 represents the installation in the creeping phase of the slab 2.

The invention obviates these drawbacks thanks to the provisions represented schematically in FIGS. 2 and 3.

FIG. 2 shows that the roller table 3 has been divided into several parts, namely a conventional first part 33 comprising a set of rollers 31 mounted on a fixed chassis and a second part 4 consisting of a certain number of rollers 41 closest to the roll stand 10, for example four rollers, which are mounted on a movable chassis 42 travelling vertically, for instance under the action of elastic supporting devices 43.

In the absence of a slab 2, the movable chassis 4 is lifted by the supporting devices 43 to an upper position determined by stop members (not shown).

When the slab 2, rolling over the first part 3 of the table, passes over the rollers 41 of the mobile table 4, this is lowered to an intermediate position, determined by the supporting devices 43 which are tared in order to compensate for the weight of the movable table 4 with the addition of the weight of the nose 22 of the slab 2.

As shown in FIG. 3, the chassis 42 can advantageously be supported entirely by elastic devices 43, and it then takes the orientation corresponding to that of the slab 2 which is thus perfectly applied on the set of rollers 41 of the movable table while resting on at least both end rollers 44, 45. The thrust load is distributed over at least three rollers, i.e., the back roller 32 and the two rollers 44, 45 of the movable table.

Thus, a greater thrust load may be exerted on the slab 2, to enhance the entry of its nose 22 between the working cylinders 1, 1'.

It should be noted that the roll bending of the slab 2 has been overrepresented in FIG. 3 and can, in practice, be quite reduced so that the slab rests not only on the end rollers 44, 45 but also on the intermediate rollers 41 of the movable table 4, which must thus also be rotary-driven. Quite advantageously, all the driving rollers of the table 3 and of the movable table 4 are rotary-driven in synchronism by a common control means (not shown) whose power is distributed automatically over the rollers touching the slab, at a precise moment.

According to the layout represented in FIG. 3, the general level of the table 3 and the taring of the springs 43 are so determined that, when the movable table 4 supports the slab 2, the medial plane Q of the nose 22 of the slab is substantially at the level of the medial plane P of the roll gap 13, whereas both front edges 23, 24 touch both cylinders 1, 1', more or less simultaneously.

The penetration of the slab then proceeds under excellent conditions, the friction effect of the cylinders 1, 1' being added to the thrust loads F1, F2, F3, applied by the rollers 32, 44, 45.

The movable table 4 may also be raised slightly so that, in its intermediate position supporting nose 22, the contact plane P3 tangent to the upper generatrices of the rollers 44, 45 is offset downwards with respect to the level of the upper generatrix 12' of the lower cylinder 1' only by a distance h which can be set between 0 and R/2, R being the thickness reduction displayed for the pass in question.

Figure 4:
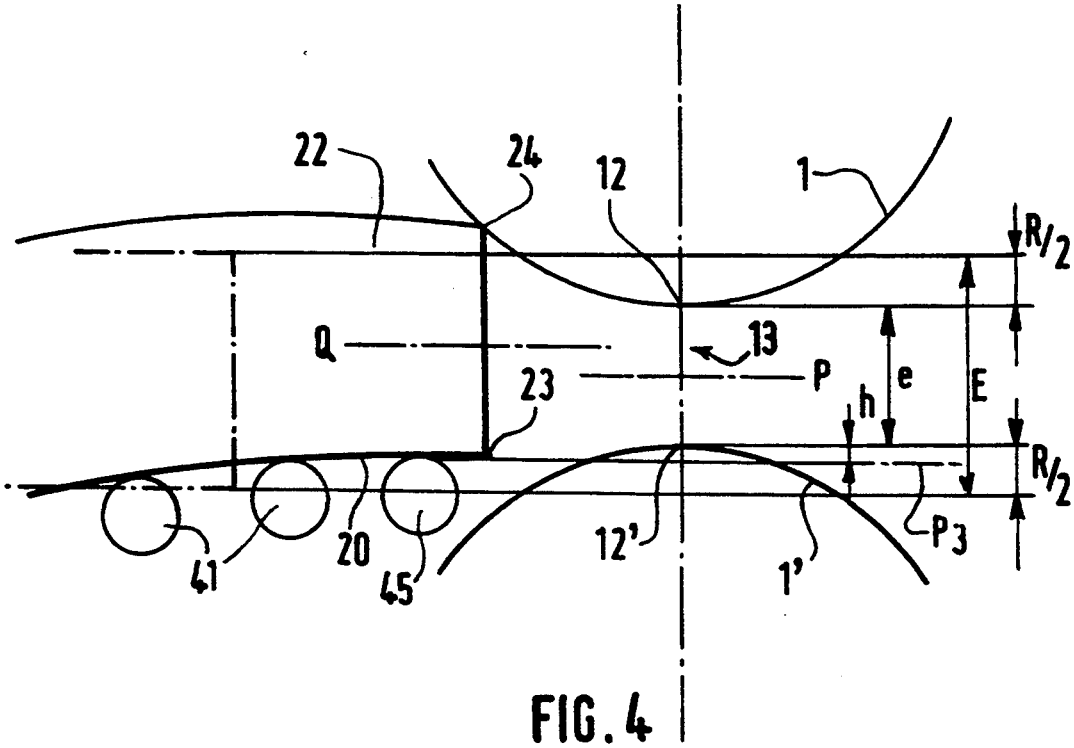
FIG. 4 shows, in enlarged scale, the beginning of entry of a slab 2.

According to the layout represented in FIG. 4, the medial plane Q of the slab 2 is then offset upwards with respect to the horizontal medial plane P of the roll gap 13 and the nose 22 first touches the upper working cylinder 1 with its upper edge 24 before reaching the lower cylinder 1'.

Moving still further forward, the slab 2 is lowered by the upper cylinder 1 while pushing the movable table 4 downwards, which increases adherence with the rollers 44, 45, until the lower edge 23 of the nose 22 touches, in turn, the lower cylinder 1'. Due to the thrust load exerted by both parts 3 and 4 of the roller table, the frictions exerted between the edges 23, 24 of the slab 2 and the working cylinders 1, 1' are sufficient to determine the penetration of the nose 22 between the cylinders 1, 1'.

It should be noted that the elastic assembly of the movable table 4 also enables reducing the loads that can be applied to the table by the rear end 25 at the end of the pass of the slab 2 when the slab is not perfectly straight.

While it may be preferable to use a movable table 4 fitted with several rollers and entirely supported by elastic means to allow suitable application on the lower surface 20 of the slab, a single movable driving roller, normally the last roller 45 of the table, could also be used.

In this case, the thrust load would still be distributed over at least two rollers, namely, the first roller 32 and the last roller 45 of the table 3.

The elastic assembly of the movable table 4, which moves between only two positions, an upper one and a lower one, could be different.

Figure 5:
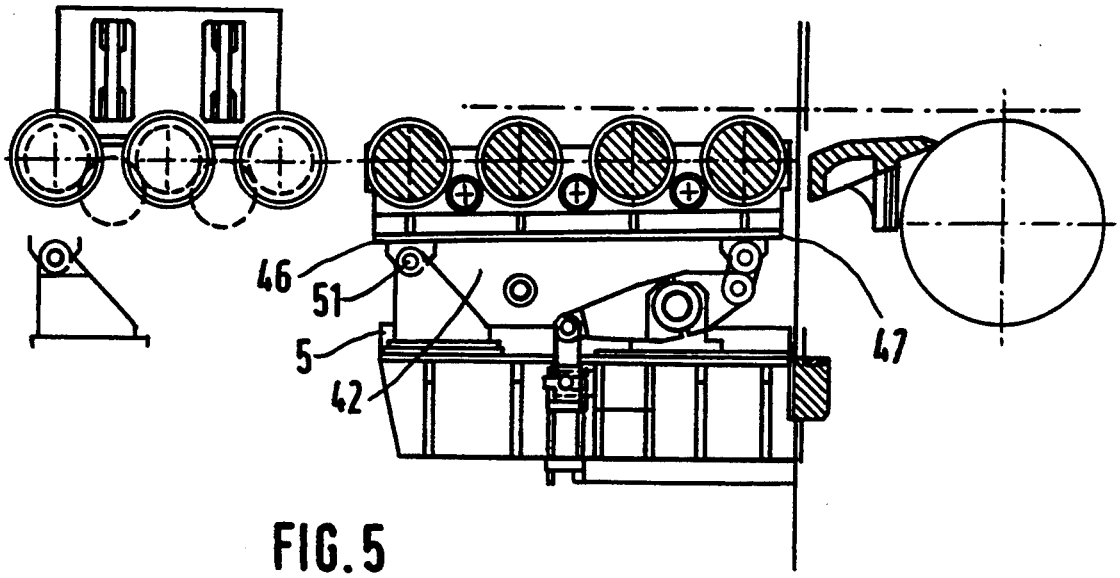
FIG. 5 represents a roller table according to the invention, in its upward position.
Figure 6:
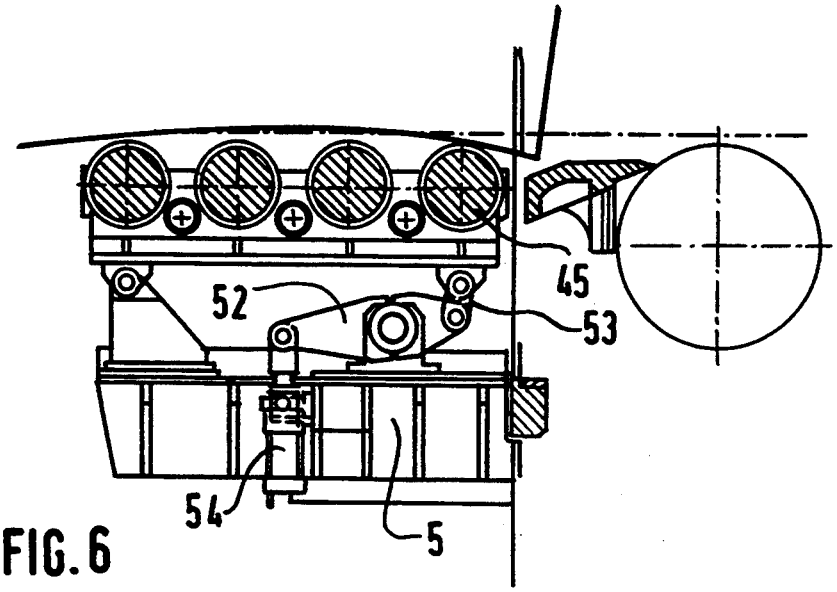
FIG. 6 represents the roller table of FIG. 5, in its lowered position.

For instance, according to the embodiment represented in FIGS. 5 and 6, the rear end 46 of the movable chassis 42 is articulated on a fixed support 5 around a horizontal axis 51, while its nose 47 directed to the roll stand 10 rests on the end of a lever 52, via a rod 53, the lever 52 being pivot-mounted around a horizontal axis on the fixed support 5 and its other end being articulated on an elastic retaining device, for instance a spring or a jack, which determines the amount of lifting for the nose of the table 4 in the raised position of FIG. 5 and allows lowering the table 4 to the position illustrated in FIG. 6, whereas the retaining device can be tared in order to adjust the level of the front roller 45 when the table 4, loaded by the nose 22 of the slab 2, is in its intermediate position.

What is claimed is:

1. Method for entering a metal slab into a roll stand in a rolling unit comprising:

a roll stand comprising an upper working cylinder and a lower working cylinder, separated by a roll gap for the passage of said slab and cylinder adjusting means for rolling of said slab, said slab having a nose delimited by two front edges respectively touching said working cylinders by entering into said roll gap, at least one roller table located upstream of said roll stand in the direction of passage of said slab into said roll gap, said at least one roller table comprising several rollers with parallel axes defining a supporting plane of said slab, said method comprising the steps of:

(a) dividing said upstream roller table into at least two parts, respectively at least a first part comprising a set of rollers mounted on a fixed chassis and defining said supporting plane, and a second part forming a movable table and comprising at least a last roller located just upstream of said roll stand in a direction of passage of said slab;

(b) mounting said second part on a movable chassis travelling vertically and resting on elastic supporting devices;

(c) adjusting said elastic supporting devices in order to compensate for a weight of the movable table plus a weight of said nose of said slab and to allow said second part to be lowered by yielding elastically under a load exerted downwards by said slab when entering into said roll gap;

(d) rotary driving at least a first roller of said first part farthest from said roll stand for pushing said slab towards said roll stand;

(e) lifting said nose of said slab by means of said elastically supported second part for applying said nose on at least said last roller of said second part;

(f) rotary driving at least said last roller of said second part for adding a thrust load to a thrust load exerted by said rotary driven first roller of said first part; and (g) determining a penetration of said nose between said working cylinders as a result of the thrust load exerted by said first and second parts of said roller table.

2. Method according to claim 1, comprising the steps of:

a) lifting said nose of said slab by means of said second part to a position such that said nose is offset upwards with respect to said roll gap and touches said upper working cylinder with an upper edge of said nose before reaching said lower working cylinder; and b) moving said slab further forward so that said nose is lowered by said upper working cylinder until it contacts said lower working cylinder while pushing downwards said last roller which yields elastically and thereby increasing application of said slab on said last roller.

3. Method according to claim 1 or 2, comprising the step of rotary-driving at least said last roller in a manner synchronous with driven rollers of said roller table by a common control means whose power is distributed automatically over the driven rollers touching said slab.

4. Method according to claim 3, comprising the step of supporting the movable chassis of said movable table entirely on elastic supporting means to allow vertical motion while adapting to an orientation of a portion of the slab which thus rests, upon penetration of said roll gap, at least on two end rollers of said movable table, at least said end rollers being rotary-driven.

5. Method according to claim 1 or 2, wherein said movable table comprises a set of rollers, said method comprising the step of rotary-driving said set of rollers in a manner synchronous with driven rollers of said roller table by a common control means whose power is distributed automatically over the driven rollers touching said slab.

6. Method according to claim 5, comprising the steps of articulating a side of said movable chassis facing said roll stand, around an axis parallel to axes of said working cylinders, and supporting on an elastic lifting means a side of said movable chassis directed towards said roll stand (10).

7. Method according to claim 1 or 2, comprising the steps of adjusting said roll gap in order to determine a reduction of an initial thickness of said slab down to a predetermined thickness, and adjusting a position of at least said last roller so that, when said last roller supports a weight of said nose of said slab, a medial plane of said slab is substantially at a level of a medial plane of said roll gap.

8. Method according to claim 1 or 2, comprising the steps of adjusting said roll gap between said working cylinders in order to determine a reduction of an initial thickness of said slab down to a predetermined thickness, and adjusting a position of said movable table so that, when said movable table supports a weight of said nose of said slab, a medial plane of said slab is slightly offset upwards with respect to a medial plane of said roll gap so that, when moving towards said roll stand, an upper edge of said nose of said slab first touches the upper working cylinder which determines lowering of said slab with at least said last roller while increasing an application load of the former on a lower surface of said slab until said slab has penetrated said roll gap.

* * * * *